US008426751B2

(12) United States Patent
Lee et al.

(10) Patent No.: US 8,426,751 B2
(45) Date of Patent: Apr. 23, 2013

(54) ELECTRICAL CONNECTOR ASSEMBLY HAVING JUXTAPOSED CONNECTORS

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 119 days.

(21) Appl. No.: 13/038,503

(22) Filed: Mar. 2, 2011

(65) Prior Publication Data

US 2012/0145452 A1 Jun. 14, 2012

(30) Foreign Application Priority Data

Dec. 10, 2010 (TW) ..... 99223975 U

(51) Int. Cl.
*H01R 13/502* (2006.01)
*H01R 13/514* (2006.01)

(52) U.S. Cl.
USPC ..... 174/520; 174/559; 174/560; 174/561; 361/729; 439/540.1; 439/541.5; 439/607.21

(58) Field of Classification Search ..... 439/540.1, 439/541.5, 607.21; 361/729; 174/50, 520, 174/535, 559–562
See application file for complete search history.

(56) References Cited

U.S. PATENT DOCUMENTS

| | | | | |
|---|---|---|---|---|
| 6,558,191 | B2 * | 5/2003 | Bright et al. | 439/541.5 |
| 6,655,995 | B1 * | 12/2003 | Reisinger et al. | 439/607.35 |
| 6,926,551 | B1 * | 8/2005 | Schulz et al. | 439/357 |
| 7,204,710 | B1 * | 4/2007 | Sato et al. | 439/326 |
| 7,275,959 | B2 * | 10/2007 | Daly et al. | 439/607.2 |
| 8,053,667 | B2 * | 11/2011 | Chen et al. | 174/50 |
| 8,182,290 | B2 * | 5/2012 | Fonteneau et al. | 439/607.21 |

* cited by examiner

*Primary Examiner* — Angel R Estrada
*Assistant Examiner* — Dimary Lopez
(74) *Attorney, Agent, or Firm* — Rosenberg, Klein & Lee

(57) ABSTRACT

An electrical connector assembly includes several casings juxtaposed to and connected to one another along an assembling direction, and a positioning bottom plate disposed at a level below the casings. Each casing includes a top plate, a side wall extending downwardly from a lateral side along a mounting direction transverse to the assembling direction, and one fixing pin projecting downward from a bottom end of the side wall. The positioning bottom plate is formed with several rows of fixing channel. Each row of the fixing channels is aligned with the fixing pins of a respective casing. When the juxtaposed casings are brought to fix securely on a printed circuit board supporting the positioning bottom plate, the fixing pins of the casings respectively extend through the fixing channels in the positioning bottom plate such that the positioning bottom plate absorbs an accumulated tolerance caused due to a juxtaposed connection among the casings along the assembling direction.

8 Claims, 4 Drawing Sheets

ELECTRICAL CONNECTOR ASSEMBLY HAVING JUXTAPOSED CONNECTORS

This application claims the benefits of the Taiwan Patent Application Serial No. 099223975 filed on Dec. 10, 2010, the subject matter of which is incorporated herein by reference.

BACKGROUND OF THE INVENTION

1. Field of the Invention

The present invention relates to a juxtaposed type electrical connector assembly, more particularly to one juxtaposed type electrical connector assembly including a plurality of juxtaposed casings and a positioning bottom plate for supporting the juxtaposed casings thereon in such a manner that the positioning bottom plate can absorb the accumulated tolerance caused due to juxtaposed connection among the casings.

2. Description of the Prior Art

A conventional electrical connector assembly generally includes a casing structure defining a plurality of plug chambers for receiving respectively several pieces of plug units provided a cable-holding member or an optical fiber switch. The casing structure presently available is made mostly from plastic material, and has a fixed number of chambers such that during manufacture of the conventional electrical connector assembly, several different pieces of molds are required in order to form the plug chambers with different sizes, hence causing the unnecessary manufacturing cost.

To overcome the aforesaid disadvantages encountered during manufacturing of the conventional electrical connector assembly, the ROC (Taiwan) patent publication number M354926 has disclosed a juxtaposed type electrical connector assembly, which includes a plurality of juxtaposed casings, wherein an adjacent pair of the juxtaposed casings share a common partition to form two plug chambers of different sizes. Hence two different plug chambers can be formed to receive different plug units therein and thus economizing the construction material and the expense for constructing new molds.

FIG. 1 illustrates how a conventional juxtaposed type electrical connector assembly is mounted onto a printed circuit board. As shown, the conventional electrical connector assembly PA100 includes a basic casing PA10 and a plurality of auxiliary casings PA20, PA20*a* juxtaposed relative to one another. The basic casing PA10 has a plurality of fixing pins PA11 and a first engaging structure PA12. Each auxiliary casing PA20 has a plurality of fixing pins PA21, a second engaging structure PA22 and a third engaging structure PA23.

The auxiliary casing PA20 is juxtaposed and connected to the basic casing PA10 via the first and second engaging structures PA12, PA22. The other auxiliary casing PA20*a* is juxtaposed and connected to the auxiliary casing PA20 via the second and third engaging structures PA22*a*, PA 23, hence the latter assembly thereof is connected to the basic casing PA10, thereby forming the conventional electrical connector assembly PA100.

After the conventional electrical connector assembly is assembled as stated in the aforesaid manner, the fixing pins PA11, PA21, PA21*a* of the basic casing PA10 and the auxiliary casings PA20, PA20*a* are inserted into a printed circuit board 200, thereby mounting the conventional electrical connector assembly securely on the printed circuit board 200.

Whether an automatic or manual mounting process is applied for mounting the conventional electrical connector assembly on the printed circuit board 200 securely, it is relatively difficult to avoid the problem of displacement phenomenon. This situation is aggravated since the conventional electrical connector assembly PA100 is formed by several pieces of the auxiliary casings PA20, PA20*a* assembled to one another in the juxtaposed connection, hence resulting in accumulated tolerance thereamong. In addition, the printed circuit board generally has a design tolerance after production, which, in turn, increases the amount of accumulated tolerance when the conventional electrical connector assembly is mounted on the printed circuit board 200. Since all the electronic devices available in the market are aimed to be produced in compact size, the casings as well as the circuit paths in the printed circuit board are required to be designed in compact manner or densely located manner. Hence the presence of accumulated tolerance during mounting the conventional assembly on the printed circuit board brings undesired effects thereof.

SUMMARY OF THE INVENTION

In the prior art technique, the conventional electrical connector assembly has a greater accumulated tolerance. However, the electrical connector assembly produced according to the present invention can absorb the accumulated tolerance, thereby reducing the displacement phenomenon during the mounting operation of the same onto the printed circuit board.

The object of the present invention is to provide an electrical connector assembly, which can overcome the disadvantages of the prior art ones. The electrical connector assembly of the present invention includes a plurality of juxtaposed auxiliary casings and a positioning bottom plate. Each of the auxiliary casings includes a top plate, a side wall extending downwardly from a lateral side of the top plate along a mounting direction and having a bottom end, and at least one fixing pin projecting downward from the bottom end of the side wall along the mounting direction. The positioning bottom plate is disposed at a level below the juxtaposed auxiliary casings, and is formed with several rows of fixing channel such that an adjacent pair of the rows is spaced apart from each other by a standard distance. Each row of the fixing channels is aligned with the fixing pin of a respective one of the auxiliary casings.

The auxiliary casings are juxtaposed and connected to one another along an assembling direction transverse to the mounting direction. When the juxtaposed auxiliary casings are brought along the mounting direction to fix securely on a printed circuit board supporting the positioning bottom plate from underneath, the fixing pins of the auxiliary casings respectively extend through the fixing channels in the positioning bottom plate in such a manner that the positioning bottom plate absorbs an accumulated tolerance caused due to the juxtaposed connection among the auxiliary casings along the assembling direction.

The electrical connector assembly of the present invention further includes a basic casing having a top plate, two side walls extending respectively and downwardly from two lateral sides of the top plate along the mounting direction toward the printed circuit board, and a plurality of basic engaging structures mounted to the top plate at the lateral sides thereof. Each of the basic engaging structures is preferably in the form of an engaging loop.

Each of the auxiliary casings further includes a plurality of first engaging structures and a plurality of second engaging structures, which are mounted respectively to the lateral sides of the top plate of a respective one of the auxiliary casings. Preferably each of the first engaging structure is a fastener hook while each of the second engaging structure is an engaging loop for receiving the fastener hook therein. Under this condition, the first engaging structures of one of the auxiliary casings adjacent to the basic casing are engaged respectively with the basic engaging structures of the basic casing, thereby juxtaposing and connecting the one of the auxiliary casings and the basic casing along the assembling direction.

In one embodiment, the electrical connector assembly of the present invention further includes a plurality of plug units respectively received within the basic casing and the plurality of auxiliary casings and are further coupled electrically to one another in series along the assembling direction.

In the conventional electrical connector assembly, after the basic casing and the auxiliary casings are coupled interactively at the top plates thereof and when inserting the fixing pins of these casings relative to the printed circuit board, the displacement phenomenon is resulted easily, hence a predetermined amount of accumulated tolerance is also resulted. However, in the electrical connector assembly of the present invention, owing to the presence of the positioning bottom plate and since two adjacent rows of the positioning channel in the positioning bottom plate are spaced apart from each other by a standard distance, the absorb amount of the accumulated tolerance during the mounting operation of the electrical connector assembly of the present invention onto the printed circuit plate is increased, which, in turn, reduces the accumulated tolerance caused due to juxtaposed connection of the basic and auxiliary casings in series along the assembling direction.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENTS

The present invention relates to a juxtaposed type electrical connector assembly, more particularly to one juxtaposed type electrical connector assembly, which includes a plurality of juxtaposed connectors in the form of casings and a positioning bottom plate for supporting the juxtaposed casings from underneath such that the positioning bottom plate can absorb the accumulated tolerance caused due to juxtaposed connection among the casings. A preferred embodiment of the juxtaposed type electrical connector assembly is disclosed in the following paragraphs for better understanding of the present invention. However, the scope of the present invention should not be limited only to the structure of the disclosed embodiment.

Figure 2:
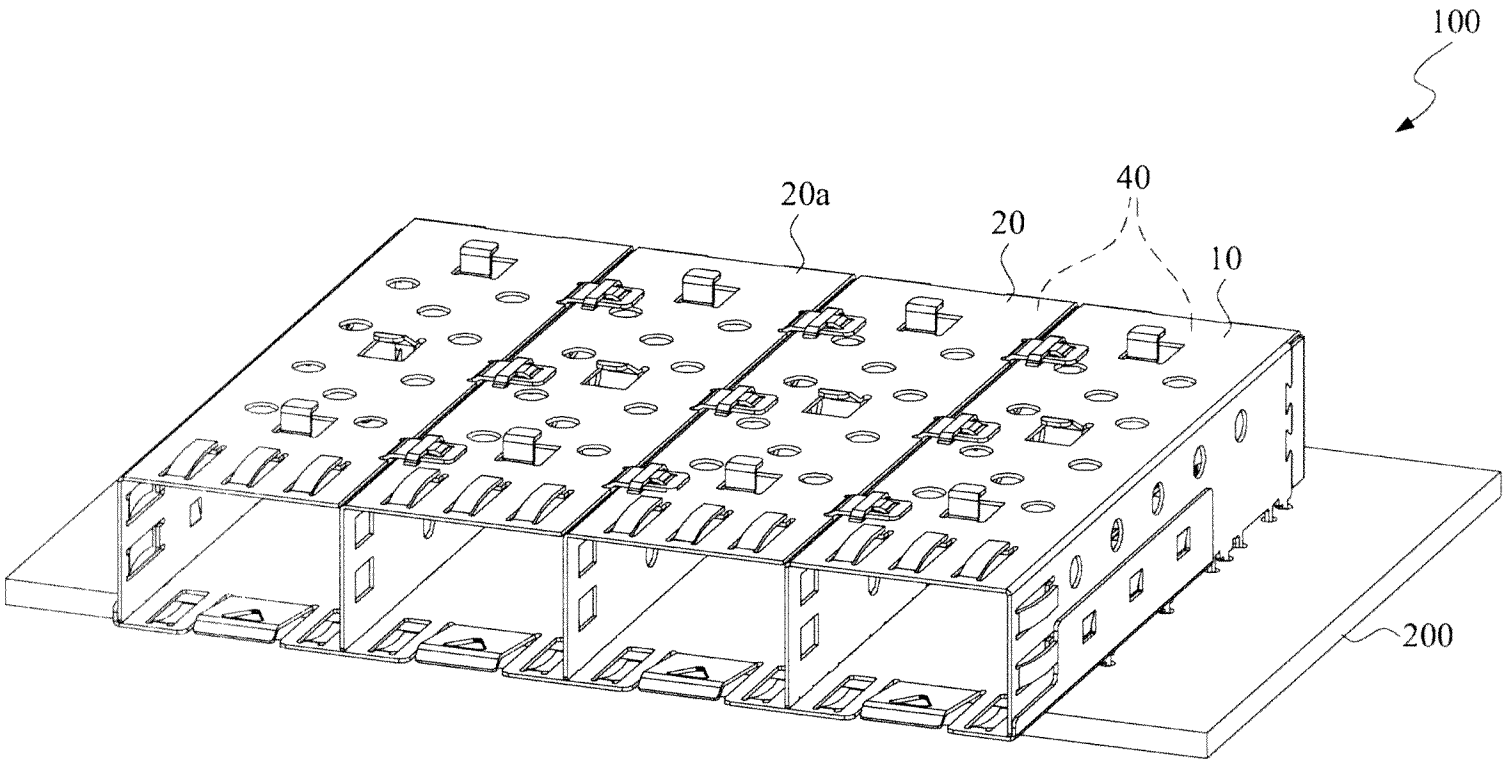
FIG. 2 shows a perspective view of a juxtaposed type electrical connector assembly of the present invention mounted onto a printed circuit board.
Figure 3:
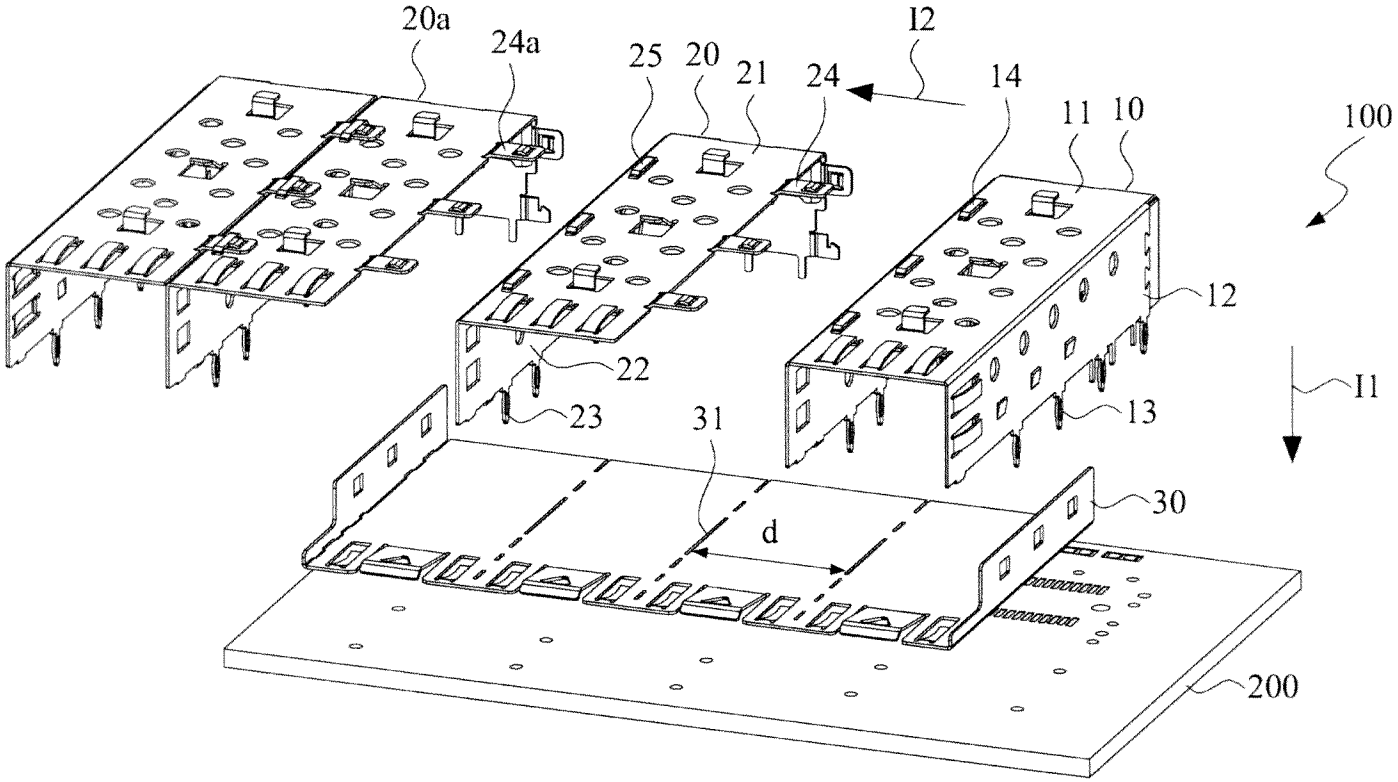
FIG. 3 illustrates an exploded view of the juxtaposed type electrical connector assembly of the present invention shown together with the printed circuit board.

Referring to FIGS. 2 and 3, wherein FIG. 2 shows a perspective view of a juxtaposed type electrical connector assembly of the present invention mounted onto a printed circuit board while FIG. 3 illustrates an exploded view of the juxtaposed type electrical connector assembly of the present invention shown together with the printed circuit board. The juxtaposed type electrical connector assembly 100 accordingly includes several pieces of connectors for respectively receiving several pieces of plug units, such as cable-holding device or optical fiber switch (see FIG. 4). The electrical connector assembly 100 of the present invention includes a basic casing 10, a plurality of auxiliary casings (only two auxiliary casings 20, 20*a* are shown in the drawings) and a positioning bottom plate 30. Note that each of the casings in fact serves as an electrical connector.

The basic casing 10 is preferably made from metal and includes a top plate 11, two side walls 12 extending respectively and downwardly from two lateral sides of the top plate 11 along a mounting direction (I1) toward the printed circuit board, a plurality of basic engaging structures 14 mounted to the top plate 11 at the lateral sides thereof and a plurality of fixing pins 13 projecting downward from bottom ends of the side walls 12 along the mounting direction (I1). Preferably, each basic engaging structure 14 is in the form of an engaging loop.

The auxiliary casings 20, 20*a* are juxtaposed and connected to one another, and extend along an assembling direction (I2) transverse perpendicularly to the mounting direction (I1). One of the auxiliary casings 20, 20*a* is juxtaposed to and assembled to the basic casing 10 along the mounting direction (I1). The auxiliary casing 20 is preferably made from metal, and includes a top plate 21, a side wall 22 that extends downwardly from a lateral side of the top plate 21 along the mounting direction (I1) and that has a bottom end, and a plurality of fixing pins 23 projecting downward from the bottom end of the side wall 22 along the mounting direction (I1).

The auxiliary casing 20 further includes a plurality of first engaging structures 24 and a plurality of second engaging structures 25 mounted respectively to two lateral sides of the top plate 21. In this embodiment, each of the first engaging structures 24 is a fastener hook while each of the second engaging structures 25 is an engaging loop for receiving the respective fastener hook therein. In this regard, the first engaging structures 24 of the auxiliary casing 20 adjacent to the basic casing 10 are engaged respectively with the basic engaging structures 14 of the basic casing 10, thereby juxtaposing and connecting the auxiliary casing 20 to the basic casing 10 in series along the assembling direction (I2).

In the same manner, the first engaging structures 24*a* of the auxiliary casing 20*a* are respectively engaged to the second engaging structures 25 of the auxiliary casing 20, thereby juxtaposing and connecting the auxiliary casing 20*a* to the auxiliary casing 20 along the assembling direction (I2). Under this condition, several pieces of plug units 40 are respectively received within the basic casing 10 and the plurality of auxiliary casings 20, 20*a* due to the reason that each casing serves as an electrical connector. In this embodiment, the pieces of plug units cooperatively form a SFP module (Small Form-factor Pluggable transceiver).

Figure 1:
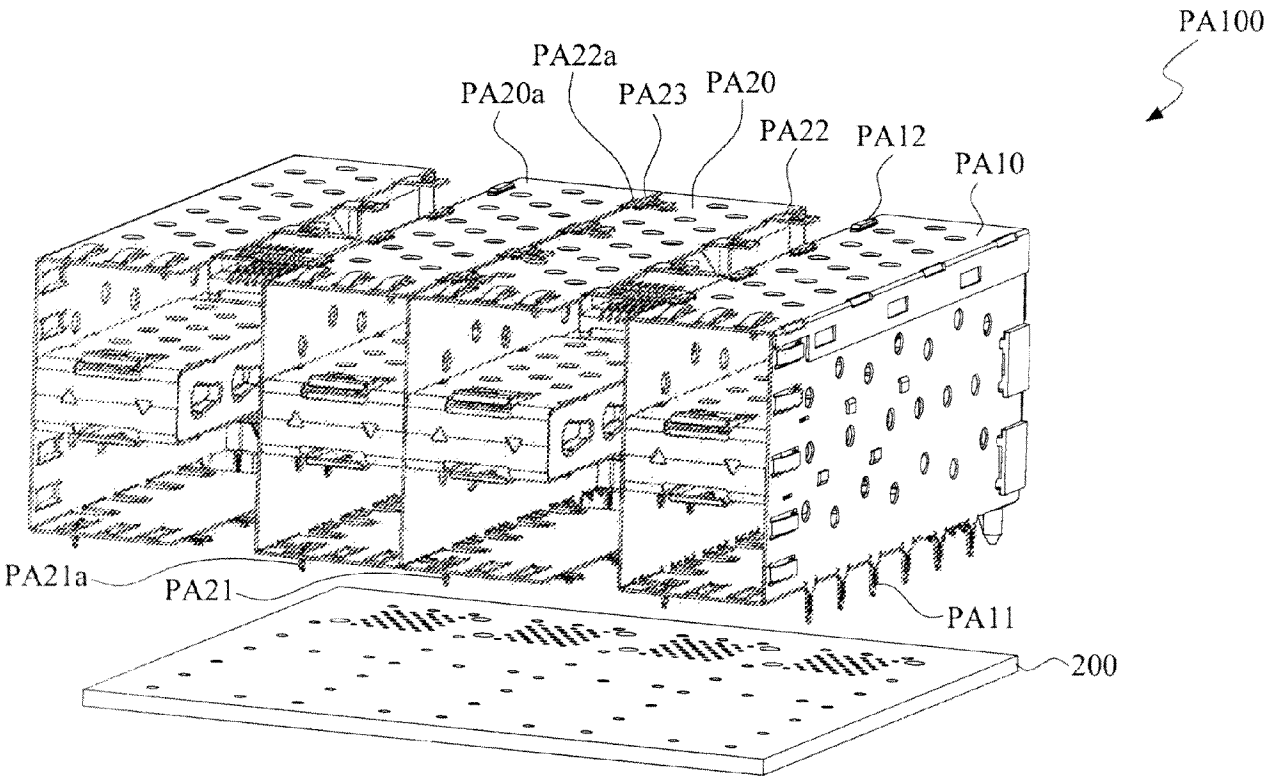
FIG.1(Prior Art)
FIG. 1 illustrates how a conventional juxtaposed type electrical connector assembly is mounted onto a printed circuit board.
Figure 4:
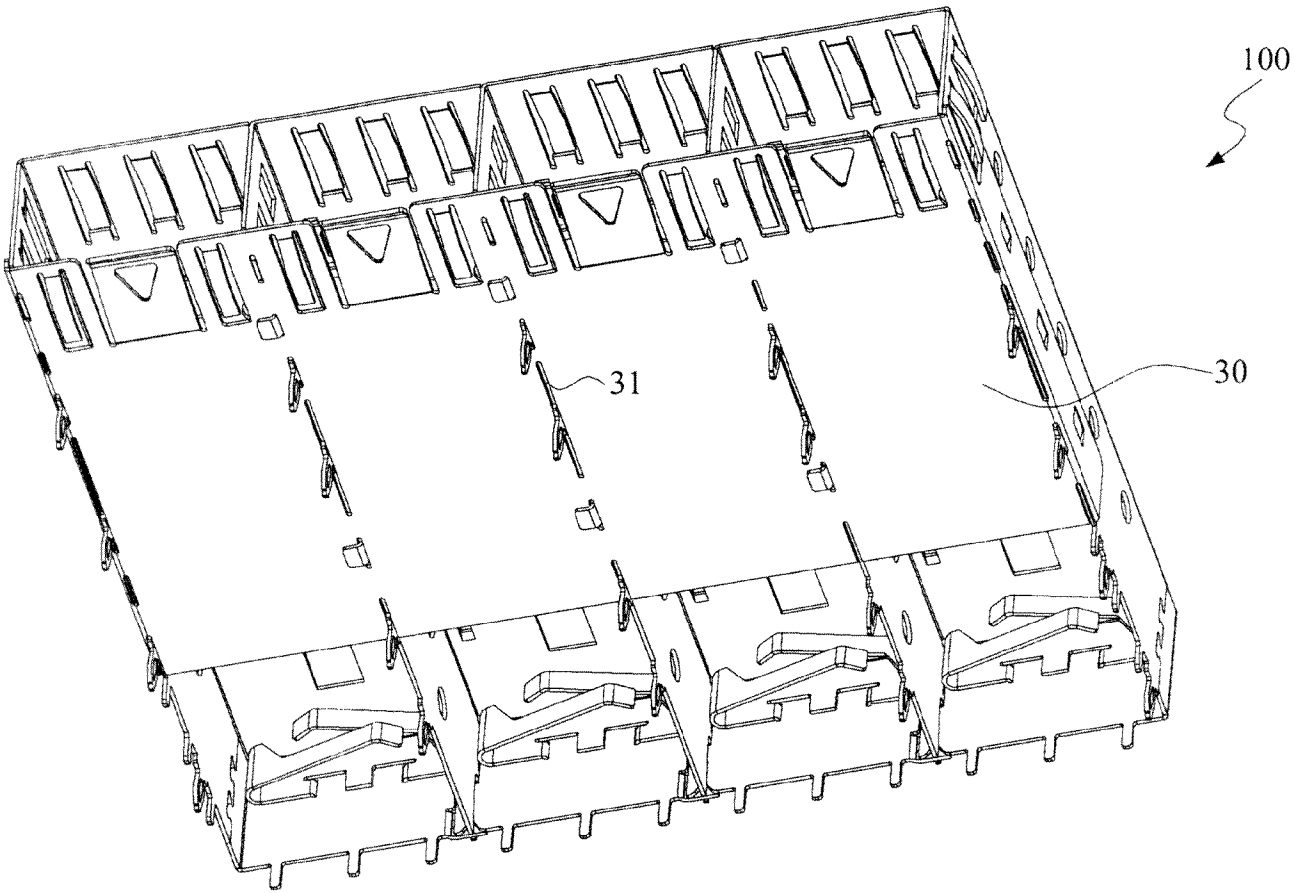
FIG. 4 shows a perspective and upside down view of the juxtaposed type electrical connector assembly of the present invention, wherein the printed circuit board is removed to better illustrate a bottom structure of a positioning bottom plate employed therein.

Referring to FIGS. 1, 3 and 4, wherein FIG. 3 illustrates an exploded view of the juxtaposed type electrical connector assembly of the present invention shown together with the printed circuit board while FIG. 4 shows a perspective and upside down view of the juxtaposed type electrical connector assembly of the present invention, wherein the printed circuit board is removed to better illustrate a bottom structure of the positioning bottom plate 30. As illustrated, the positioning bottom plate 30 is fabricated from a punching process, is disposed at a level below the basic casing 10 and the auxiliary casings 20, 20*a*, and is formed with several rows of fixing channel 31. To be more specific, an adjacent pair of the rows is spaced apart from each other by a standard distance (d). Each row of the fixing channels 31 is aligned with the fixing pins 23 of a respective one of the auxiliary casings 20, 20*a*.

After assembling the basic casing 10 and the auxiliary casings 20, 20*a* in series along the assembly direction (I2) as described above, and when it is desired to mount the assembly thereof onto a printed circuit board 200 which is disposed below and supporting the positioning bottom plate 30 from underneath, the assembly is brought downward along the mounting direction (I1) to fix securely on the printed circuit board 200. Under this condition, the fixing pins 13, 23 of the basic casing 10 and the auxiliary casings 20,20*a* respectively extend through the fixing channels 31 in the positioning bottom plate 30 in such a manner that the positioning bottom plate 30 absorbs an accumulated tolerance caused due to the juxtaposed connection among the basic casing 10 and the auxiliary casings 20, 20*a* along the assembling direction. In other words, the displacement phenomenon during mounting operation of the electrical connector assembly 100 onto the printed circuit board 200 is reduced considerably, hence upgrading the mounting precision of the electrical connector assembly 100 of the present invention relative to the printed circuit board 200.

In the conventional electrical connector assembly, after the basic casing and the auxiliary casings are coupled interactively at the top plates thereof and when inserting the fixing pins of these casings relative to the printed circuit board, the displacement phenomenon is resulted, hence a predetermined amount of accumulated tolerance is also resulted. However, in the electrical connector assembly of the present invention, owing to the presence of the positioning bottom plate 30 and since two adjacent rows of the positioning channel 31 are spaced apart from each other by a standard distance (d), the absorb amount of the accumulated tolerance during the mounting operation of the electrical connector assembly 100 of the present invention onto the printed circuit plate 200 is increased, which, in turn, reducing the accumulated tolerance caused due to juxtaposed connection of the basic and auxiliary casings 10, 20, 20*a* in series.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector assembly comprising:

a plurality of auxiliary casings juxtaposed and connected to one another along an assembling direction, each of said auxiliary casing including an auxiliary casing top plate, an auxiliary casing side wall extending downwardly from an auxiliary casing lateral side of said auxiliary casing top plate along a mounting direction transverse to said assembling direction and having a bottom end, at least one fixing pin projecting downward from said bottom end of said side wall along said mounting direction, a positioning bottom plate disposed at a level below said juxtaposed auxiliary casings, and formed with several rows of fixing channel, adjacent pair of said rows being spaced apart from each other by a standard distance, each row of said fixing channels being aligned with said fixing pin of a respective one of said auxiliary casings; and a basic casing including:

a basic casing top plate, two basic casing side walls extending respectively and downwardly from two basic casing lateral sides of said basic casing top plate along said mounting direction toward a printed circuit board, and a plurality of basic engaging structures mounted to said basic casing top plate at said basic casing lateral sides thereof;

wherein, when said juxtaposed auxiliary casings are brought along said mounting direction to fix securely on said printed circuit board supporting said positioning bottom plate from underneath, said fixing pins of said auxiliary casings respectively extend through said fixing channels in said positioning bottom plate in such a manner that said positioning bottom plate absorbs an accumulated tolerance caused due to a juxtaposed connection among said auxiliary casings along said assembling direction.

2. The electrical connector assembly according to claim 1, wherein each of said auxiliary casings further includes a plurality of first engaging structures and a plurality of second engaging structures, which are mounted respectively to said lateral sides of said top plate of a respective one of said auxiliary casings.

3. The electrical connector assembly according to claim 2, wherein said first engaging structures of one of said auxiliary casings adjacent to said basic casing are engaged respectively with said basic engaging structures of said basic casing, thereby juxtaposing and connecting said one of said auxiliary casings and said basic casing along said assembling direction.

4. The electrical connector assembly according to claim 3, wherein said first engaging structures are a plurality of fastener hooks while said second engaging structures are a plurality of engaging loops for receiving said fastener hooks therein.

5. The electrical connector assembly according to claim 4, further comprising a plurality of plug units respectively received within said basic casing and said plurality of auxiliary casings.

6. The electrical connector assembly according to claim 5, wherein said plurality of plug units are respectively received within said basic casing and said plurality of auxiliary casings and are further coupled electrically to one another in series along said assembling direction.

7. The electrical connector assembly according to claim 1, further comprising a plurality of plug units respectively received within said basic casing and said plurality of auxiliary casings.

8. The electrical connector assembly according to claim 7, wherein said plurality of plug units are respectively received within said basic casing and said plurality of auxiliary casings and are further coupled electrically to one another in series along said assembling direction.

* * * * *